United States Patent [19]

Comeau

[11] 4,254,815

[45] Mar. 10, 1981

[54] CURTAIN SUPPORTING AND POSITIONING COMBINATION

[75] Inventor: Paul E. Comeau, Warwick, R.I.

[73] Assignee: Kenney Manufacturing Company, Warwick, R.I.

[21] Appl. No.: 23,071

[22] Filed: Mar. 23, 1979

[51] Int. Cl.[3] ..... A47H 1/00

[52] U.S. Cl. ..... 160/126

[58] Field of Search ..... 160/123–126, 160/330, 345–348

[56] References Cited

U.S. PATENT DOCUMENTS 3,667,531 6/1972 Wilkins ..... 160/126

*Primary Examiner*—Peter M. Caun

[57] ABSTRACT

A traverse rod curtain support combination is provided with a draw cord adapted to actuate curtain supporting master carriers through a lost-motion arrangement which permits the curtain to be drawn to a fully opened position with the curtain halves at each side to a fully closed position at the mid-point of the rod despite the presence of substantially more curtain material in one curtain half than in the other. The draw cord is arranged so that it can be adjusted relative to the master carriers externally of the rod. The combination is particularly suitable for slat type curtains (sometimes called "woven wood"), which requires an extra slat in one curtan half and the lost motion arrangement makes it possible to provide a light-tight abutment at the mid-point of the rod when the curtain is closed as well as a compact arrangement of the curtain material at each side when the curtain is fully opened.

8 Claims, 9 Drawing Figures

OPEN

CLOSING

CLOSED

OPENING

CURTAIN SUPPORTING AND POSITIONING COMBINATION

FIELD OF THE INVENTION

This invention relates to curtains and curtain supports, and more particularly to traverse rods provided with means for assuring full mid-point closure and full lateral opening of curtains which have more material on one side component of the curtain than on the other. A specific application for the invention relates to hinged slat type curtains, sometimes referred to as "woven wood".

BACKGROUND OF THE INVENTION

Curtains of the hinged slat type are customarily mounted to move in accordian fashion between an opened position with the curtain material compressed at the sides, to a closed position with the curtain material spread out across the window opening and the inner curtain edges abutting at the mid-point of the rod. It is desirable, however, to provide a light-tight abuttment when the curtain is in the closed position, and to do so requires an extra slat in one curtain half to provide an effective overlap at center line of the window. The extra slat, however, creates a further problem. If the curtains are supported on a traverse rod, in the conventional manner, one of two things happens. Either the curtains cannot be fully closed at the mid-point of the rod, or they cannot be fully opened to the sides. This is due to the extra slat on one side. Thus, if the cords are adjusted so that the curtain opens fully to the sides, drawing the curtains to the closed position requires pulling one side of the curtain to a point beyond the mid-point of the rod. When this happens, the effect is particularly disturbing because the eye immediately sees the difference in the spacing of the slats on one side of the curtain than on the other. Also, the center line of the curtain is not exactly in the middle and the human eye readily notices such an imbalance. Conversely, if the pull cords are adjusted to make the curtain halves meet perfectly at the mid-point of the rod and with the slats all perfectly spaced, then when the curtain halves are pulled to the opened position, one side reaches the fully gathered position before the other. This leaves the latter side in an ungathered position which is likewise unsightly and is readily noticed by the human eye.

Accordingly, an object of the present invention is to provide a lost-motion means for fully opening a pair of curtain components in which one component has substantially more material than the other, and to fully close the same components with a light-tight overlap, at the center line of the curtain. A further object is to provide a means for externally adjusting master carriers adapted to accomplish the foregoing objective for various rod lengths. Still a further object is to provide such a means for use with hinged slat type, "woven wood" curtains.

BRIEF DESCRIPTION OF THE INVENTION

In the accomplishment of these and other objects of the present invention in a preferred embodiment thereof, a curtain rod is mounted appropriately adjacent to a window, door or other opening for which a curtain closure is desired. The curtain in the preferred embodiment comprises a multiplicity of hinged slats vertically disposed and arranged to form right and left hand curtain components. The rod comprises two telescoping sections adapted to fit openings of various widths. It is equipped with right and left hand master carriers mounted to slide in the rod from a closed position at the mid-point of the rod to an opened position with one master near each end of the rod. A multiplicity of idler carriers are also mounted to slide on the rod. The slats are pivotally connected to the carriers to pivot about a vertical axis on the center line of each slat, with the innermost slat of each curtain component being connected to one of the masters, and with the idler which supports the outermost slat of each curtain component being fixed at the respective ends of the rod. Internally of the rod and associated with the master carriers, a pull cord is provided to actuate the master carriers and to pull the curtain between the opened and closed positions. At the top of the slats, means are provided to limit the angle to which the slats can open so that when the curtain is in the closed position the curtain halves meet at the mid-point of the rod with perfect overlap and equal slat spacing on both sides of the center line with one curtain half having one more slat than the other half. Complete opening and closing of the curtain is made possible by a lost motion arrangement associated with one of the master carriers whereby when one carrier reaches the fully opened or fully closed position the other carrier can be further pulled to its fully opened or closed position. In one embodiment, the lost motion arrangement is associated with only one of the master carriers and involves leading the draw cord from each end of the rod to a ring within the master carrier and then back to a point at the end of the carrier. The ring is free to move within the master carrier and therefore when the master carrier comes to the place where it cannot move further by reaching the fully opened or fully closed positions, the draw cord can be drawn additionally so as to bring the other master carrier to its fully opened or fully closed positions.

Adjustment of the draw cord relative to the master carriers is done once the overall desired length of the traverse rod has been selected. Adjustment is accomplished in one embodiment by securing one end of the draw cord at the master carriers to one end of the each master carrier, and leading the other (complementary) end of the draw cord at the master carriers out of each master carrier to an exposed point at the rear. The master carriers are then positioned with the curtain fully opened, and the exposed ends of draw cord at the masters are drawn so that the exposed loop of the draw cord at the end of the traverse rod is appropriately tensioned or adjusted to the correct length. Next the exposed cord ends at the master carriers are clamped to the respective carriers, and the excess is cut off. A feature of this embodiment is that it permits the master carriers to be largely hidden within an inverted U-shaped curtain rod, which rods are highly desirable for supporting heavy curtains.

In another embodiment, the draw cord is adjusted relative to the master carriers by having the ends of the draw cord at the master carriers in the form of an exposed loop which may be pulled over a locking hook and thereby hold the draw cord in position relative to the master but for the lost motion provided by the ring.

BRIEF DESCRIPTION OF THE DRAWINGS

A preferred embodiment of the invention selected for purposes of illustration is shown in the accompanying drawings in which.

DETAILED DESCRIPTION OF THE INVENTION

Figure 5:
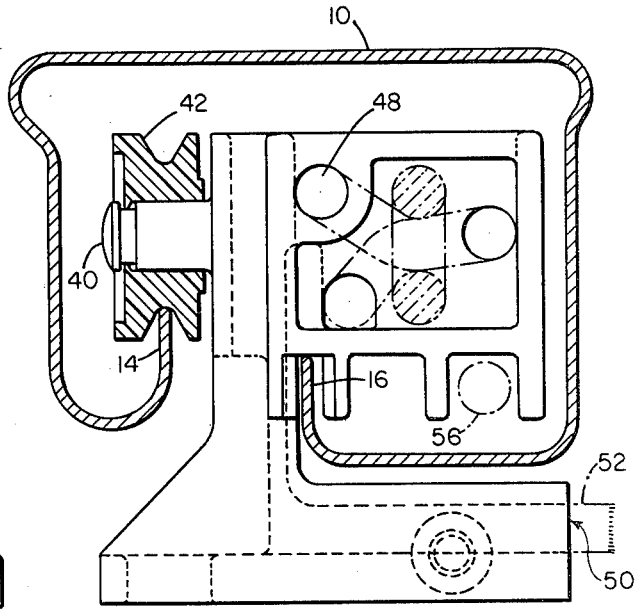
FIG. 5 is a view in end elevation from the right of the master carrier of FIG. 2 installed in a curtain rod tube shown in cross section.
Figure 6:
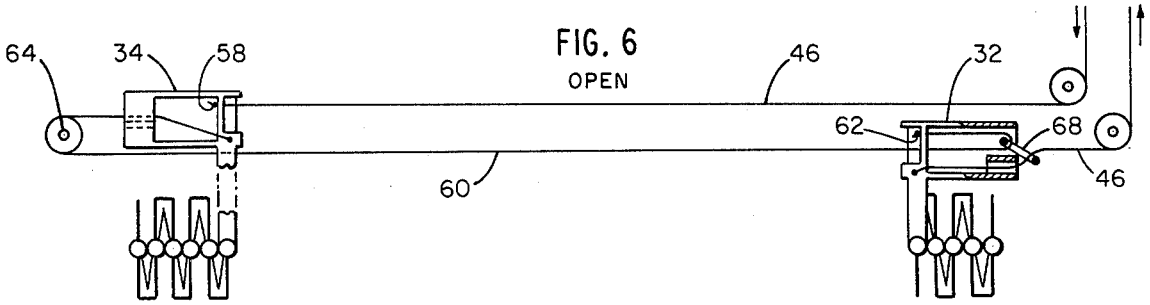
FIGS 6–9 are diagrammatic plan views illustrating the mode of operation of the lost motion features respectively in the open, closing, closed, and opening conditions.
Figure 7:
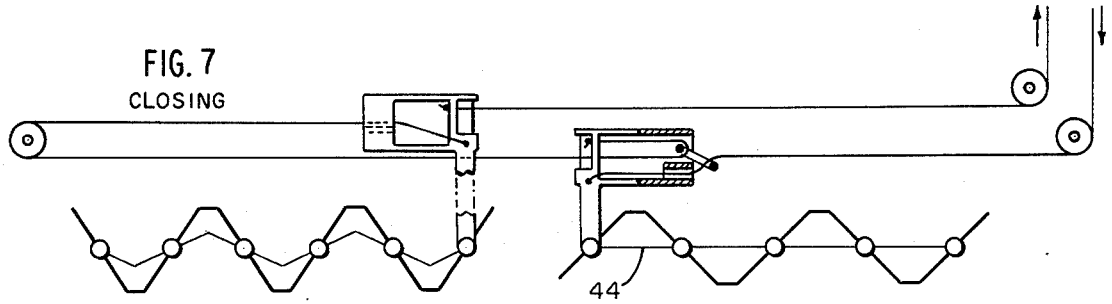

The preferred embodiment of the invention is illustrated in the context of a telescoping traverse rod for supporting hinged slat type carriers, in which a rod 10 (only one of which's telescoping members is shown) is supported by brackets 12 at each end of the rod and at intermediate points as required, the rod 10 is formed in the shape of an inverted U with a slat extending along its underside having up-turned edges forming a forward track 14 and a rear track 16 (see FIG. 5).

The curtain is formed by slats 18 hinged at 20 by flexible fabric, or other material. At the top of each slat 18 a molded plastic slat support head 22 is affixed to each of the slats. Support heads 22 are provided with central base members 24 on each of which is mounted upstanding support pin 26 having an enlarged flanged head 28.

Figure 1:
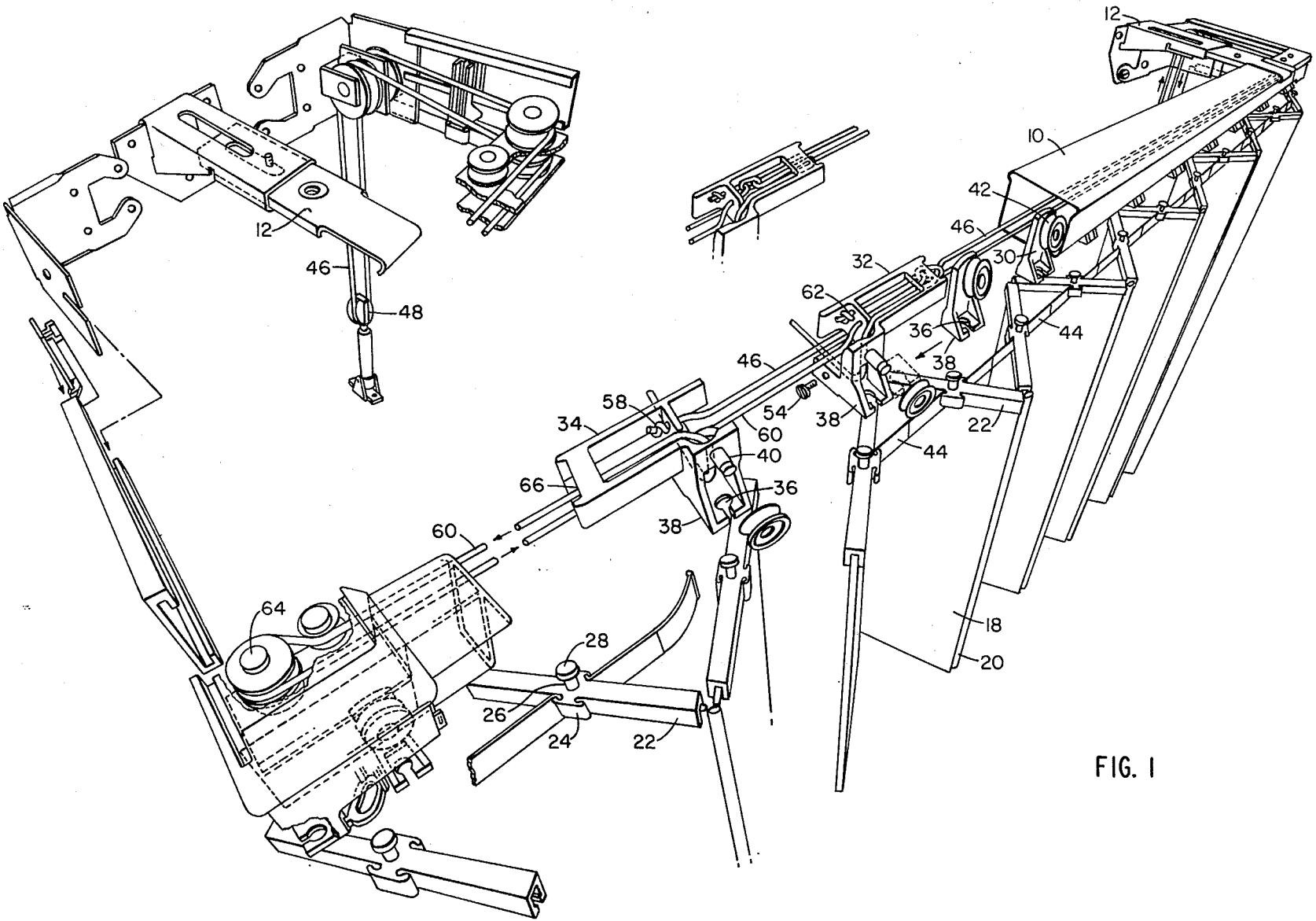
FIG. 1 is a partially exploded view in perspective of the structure of the invention in the context of a traverse rod supporting a hinged slat type of curtain.
Figure 8:
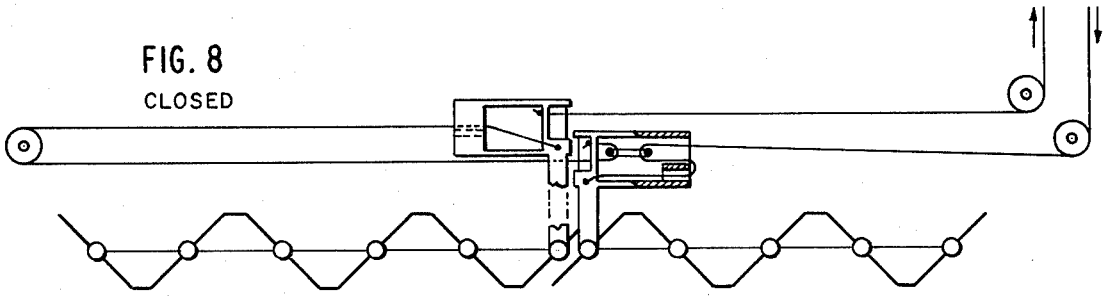
Figure 9:
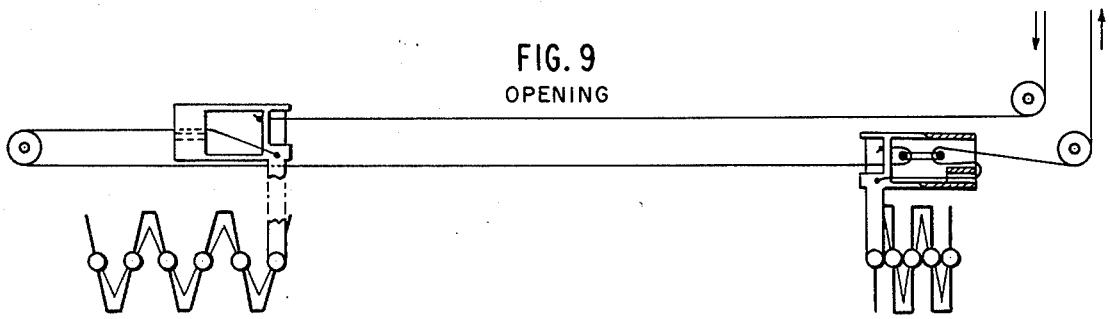

Idler carriers 30, a right hand master carrier 32 and a left hand master carrier 34 are provided to support the curtain, with support pins 26 snapping into key-hole slots 36 provided in depending support brackets 38 on the underside of each of the idler and master carriers. Each master and idler is also provided with a horizontal forwardly extending pulley pin 40 onto which a pulley 42 is snapped. The pulleys 42 ride on front track 14 of the rod and provide a movable support which permits the curtain to be drawn between a fully opened and a fully closed position. The travel of the curtain to the fully closed position with the slats spread out to their maximum angle is limited by flexible spacers 44 which are connected between the respective central base members 24. The spacers are of uniform length and hold the slats at a uniform spacing when the curtain is closed. With reference to FIG. 8, it will be seen that an extra slat 18 is needed on one side of the curtain to provide a light-tight overlap at the center of the curtain. As shown in FIG. 8 there are six slats on the left hand side, and 5 slats on the right. When the curtain is fully open the gathered material is therefore thicker on the left hand side than on the right. In order to pull the curtain to the respective fully opened and fully closed positions a lost motion arrangement for the pull cord at one of the carriers is required. In the preferred embodiment herein shown this is accomplished by employing a draw cord loop 46 to actuate the master carriers 32 and 34. The draw cord loop 46 extends outwardly of one end of the rod 10 (over appropriately arranged pulleys in the rod) and around a tension pulley 48 (see FIG. 1 upper left). Inside the rod, one strand of the draw cord loop 46 is passed through opening 48 in right hand master carrier 32 (see FIGS. 2, 3, and 5), and thence through the carrier, down into hole 50 and out to the rear of the carrier at 52. Associated with hole 50 is a set-screw 54 which is used to clamp the cord to the master carrier 32. The other strand of draw cord loop 46, passes under the right hand master as indicated in dotted lines at 56 in FIG. 5, and on to the left hand master carrier 34 to which it is affixed as indicated at 58. The draw cord connections to the master carriers are completed by a second draw cord loop 60 one strand of which is affixed as indicated at 62 to the right hand master carrier 32, and after passing under left hand carrier 34, and around a pulley 64 at the opposite end of the rod from that occupied by draw cord loop 46, enters left hand carrier 34 at 66 whereupon it passes downwardly through a hole (not shown) and outwardly to the rear where it is likewise clamped and affixed to master carrier 34 by a set-screw (not shown) exactly in the same manner as described above for master carrier 32.

Thus, when the strands of cord loop 46 are drawn they respectively pull one or the other of the master carriers which, through operation of loop 60 pulls the other master, thereby opening or closing the curtain.

Figure 2:
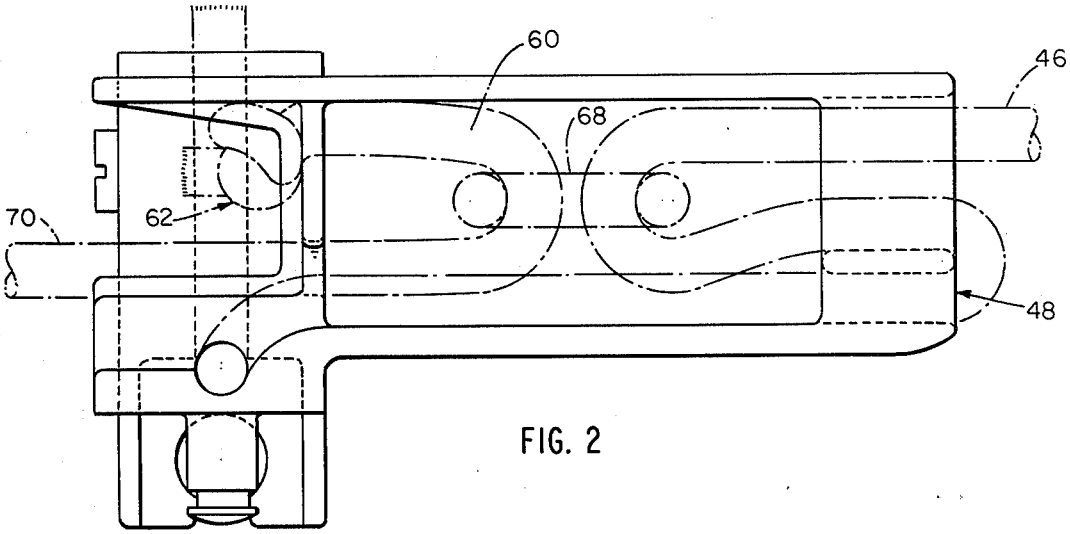
FIG. 2 is a plan view of a right-hand master carrier showing the draw cord lost motion elements in dotted lines.
Figure 3:
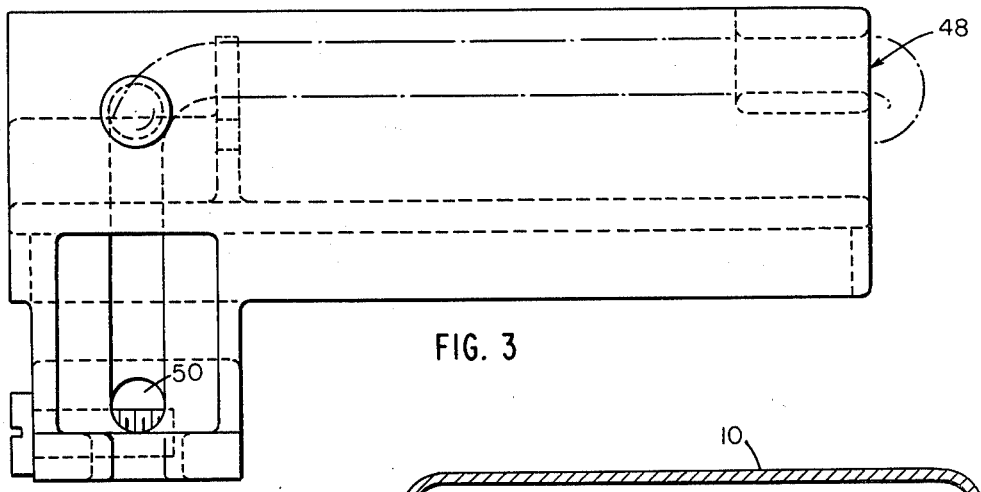
FIG. 3 is a view in front elevation of the master carrier of FIG. 2.
Figure 4:
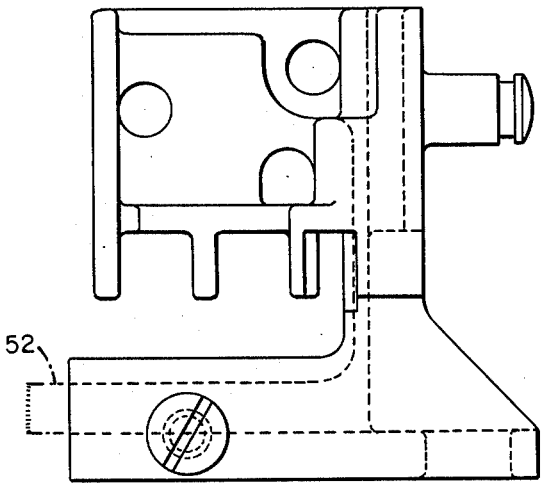
FIG. 4 is a view in end elevation from the left of the master carrier of FIG. 2.

The lost-motion arrangement required for moving the curtain which has unequal numbers of slats on the respective sides of the center line, is achieved by a double loop and ring arrangement within master carrier 32, in which loop 60 starts at 62 and extends at first to the right inwardly of master 32 to ring 68 and then back to the left and out of master 32 as indicated at 70 in FIG. 2. Conversely, loop 46 enters master 32 from the right, first passes through ring 68 then back around the right hand end of carrier 32 and into hole 48. With this arrangement, as may be seen in FIGS. 6–9, starting with the curtain fully opened, that is with the curtain material fully gathered at each end, set-screw 54 is loosened and cord loop 46 is drawn through hole 50 to achieve the correct tension on cord loop 46 with ring 68 pulled to the right hand end of carrier 32. In this same position loop 60 is pulled to the rear and clamped by set-screw in the same way with all slack removed from loop 60. Next the strand of loop 46 which leads to master carrier 34 is pulled. This causes master carrier 34 to travel toward the center of the traverse rod and through operation of loop 60 causes master carrier 32 to do likewise from the opposite end. As the closing continues right hand master carrier 32 carries the curtain to the point at which spacers 44 stop further motion of the right hand side of the curtain. Continued pulling of the same strand of cord loop 46 now causes cord loop 60 to pull on ring 68 which in turn pulls the other strand of cord loop 46 into master carrier 32. Ring 68 than continues to shift position within master carrier 32 until master carrier 34 is brought into abuttment with master carrier 32 and a snug overlapping fit has been achieved at the center line of the curtain.

With reference to FIG. 8, it wil be seen that the curtain presents only five slat protrusions and that the center line of the curtain is actually represented by the third, or middle protrusion whereas the master carriers themselves abut at a point further to the right by a distance corresponding to one half the projected width of a slat. The master carriers, however, are not seen from the front of the rod, and their noncentral position is not noticed. However, since they hold the central slat protrusion in the correct position, the desired visual balance is attained.

In FIGS. 6–9, for simplicity of explanation, the respective strands of cord loops 46 and 60 are shown spaced laterally of the master carriers at the points where the cords pass the masters, and the master carriers are also shown in an axially offset position. In actual practice, however, both masters travel on tracks 14 and 16 which retains them in precise axial alignment. Also one portion of each of the cord loops passes directly under each master carrier as may be seen in FIG. 1 Therefore, it will be appreciated that FIGS. 6–9 do not accurately depict the actual spacial relationships of the parts, but show them instead in a way which merely makes it easier to explain the mode of operation of the lost-motion arrangement.

It will also be noted that the cord anchoring hole 50 in master carrier 32 can be enlarged to accommodate two cord thicknesses and that cord 60 can then be extended from point 62 down through hole 50 where it can be integral with cord 46 to form an external loop at the rear of the carrier. A similar loop can be formed by integrating cords 46 and 60 at master carrier 34. In such a case, the two ends of the cord appear externally of the rod in the vicinity of tension pulley 48 where tassels are attached to them to facilitate pulling them to open and close the curtain.

The lost motion arrangement herein described is especially useful with hinged slat type curtains in combination with the inverted U-shaped rod as described, but it also may be employed with other types of curtains and curtain rods where uneven master carrier travel is desired. Accordingly, the lost motion arrangement is to be claimed both broadly for use with all types of curtains and rods, and narrowly for use with the hinged slat form of curtain herein described.

In addition, the precise form of the arrangement of ring 68 is desirable, but the cords can also be simply looped to each other and the point of connection will move instead of the ring 68. Such an arrangement works although its frictional resistance is greater. Frictional resistance can be still further reduced by using a pair of small pulleys instead of the ring 68, but such an arrangement takes up more space and is more expensive. The ring 68 represents a good compromise.

Further modifications of the specific embodiments herein shown will now be evidence to those skilled in the art and thereafter the invention should not be limited to the precise form herein shown but rather in terms of the appended claims.

I claim:

1. A traverse rod and curtain support combination comprising:

a pair of master carriers for transporting the mating margins of a pair of curtain components between an opened and a closed position;

a pull cord in the form of a loop mounted longitudinally of said rod with one strand of the loop attached to one said master carrier and the other strand attached to the other master carrier, whereby pulling one strand of the loop pulls the masters apart to the opened position and pulling the other strand pulls the masters in the opposite direction to the closed position at a point near the center of said rod but separated therefrom by a predetermined specific dimension, means at one said master carrier for providing a limited dimension of lost motion between said draw cord and the master, said dimension of lost motion being equal to said predetermined specific dimension to one side of the centerline of the curtain at which the masters are intended to meet in the closed position whereby when one master arrives at the opened or closed position before the other master has reached its corresponding position, said cord can be pulled additionally to bring the other master to its corresponding position.

2. The traverse rod and curtain support combination defined in claim 1 further characterized by said lost motion means comprising a pair of interconnected lost motion loops with one strand of each lost motion loop connected to the carrier and the other strand thereof extending longitudinally of the rod whereby pulling the draw cord relative to the master carrier causes the position of the connection between the lost motion loops to shift longitudinally of the master carrier.

3. The traverse rod and curtain support combination defined in claim 2 further characterized by the connection between said lost motion loops comprising a ring.

4. A curtain and support combination comprising:

a curtain rod;

means for mounting said rod on a base;

a curtain comprising a pair of curtain components, one of which has substantially more material width than the other;

means for supporting said curtain components on said rod with the outside lateral edges of each curtain component fixed to said rod but with the remaining portions of said curtain components sliding on said rod between an opened position at which each curtain component is gathered at the respective ends of the rod to a closed position at which the curtain components touch at the mid-point of said rod;

means including a pull cord for drawing said curtain components between said opened and closed positions;

means associated with each curtain component for limiting its travel at its own respective opened and closed positions; and lost motion means associated with said draw cord for providing limited lost motion for continuing to draw one curtain component after the other has reached the limit of its travel in any one direction by a dimension equal to the difference in width between said curtain components.

5. A curtain and support combination comprising:

a curtain rod;

means for mounting the rod on a base;

a curtain comprising a multiplicity of vertically arranged, hinged slats divided into right and left hand curtain components;

right and left hand master carriers mounted to move relative to said rod from a closed position at a relatively central point on said rod to an opened position with one master near each end of said rod;

a multiplicity of idler carriers mounted to slide on said rod;

means for pivotally connecting the top of each slat to one said carrier to pivot about a vertical axis on the longitudinal center line of each slat with the innermost slat of each curtain component being connected to one said master carrier and the idler which supports the outermost slat of each curtain component is connected, fixed against sliding motion relative to said rod at the end thereof;

means including a draw cord for moving the master carriers between the opened to the closed positions;

means at the tops of said slats for limiting the pivotal motion of said slats relative to each other to a specific predetermined angle;

said curtain components dimensioned in relation to said limiting means and said rod so that said slats are at the maximum angle of divergence relative to each other when the curtain is in the closed position with the inner slat of each curtain component lying in close, parallel, overlapping relation;

and lost-motion means associated with the draw cord and one master carrier for moving the other master to the fully opened and fully closed positions after the first master carrier has reached such a position.

6. The curtain and support combination defined in claim 5 further characterized by said rod comprising an inverted U-shaped cross section, having a slot along the underside thereof;

an upstanding track adjacent to said slat, and a pulley on each said master and idler carriers riding on said track.

7. The curtain and support combination defined in claim 5 further characterized by one said curtain component having at least one more slat than the other said component.

8. The traverse rod and curtain support combination defined in claim 5 further characterized by said lost-motion means comprising a pair of interconnected lost-motion loops with one strand of each lost-motion loop connected to the carrier and the other strand thereof extending longitudinally of the rod whereby pulling the draw cord relative to the master carrier causes the position of the connection between the lost motion loops to shift longitudinally of the master carrier.

* * * * *